United States Patent [19]

Haus

[11] 4,274,084

[45] Jun. 16, 1981

[54] AUDIO-VISUAL SIGNAL CIRCUITS

[75] Inventor: Rein Haus, Manasquan, N.J.

[73] Assignee: Wheelock Signals, Inc., Long Branch, N.J.

[21] Appl. No.: 88,632

[22] Filed: Oct. 26, 1979

[51] Int. Cl.[3] ..... G08B 7/00

[52] U.S. Cl. ..... 340/326; 340/331; 340/371; 340/384 E; 315/135

[58] Field of Search ..... 340/326, 331, 332, 384 E, 340/371, 75, 77, 88, 105, 400, 401; 315/241 S, 241 P, 241 R, 240, 129, 135, 242-244; 116/3

[56] References Cited

U.S. PATENT DOCUMENTS

| | | | |
|---|---|---|---|
| 2,696,598 | 12/1954 | Lozowski | 340/75 |
| 3,355,626 | 11/1967 | Schmidt | 315/241 P |
| 3,810,149 | 5/1974 | Miller et al. | 340/326 |
| 3,898,514 | 8/1975 | Takahashi | 315/241 P |
| 4,101,880 | 7/1978 | Haus | 340/326 |

*Primary Examiner*—John W. Caldwell, Sr.
*Assistant Examiner*—Donnie L. Crosland
*Attorney, Agent, or Firm*—Brumbaugh, Graves, Donohue & Raymond

[57] ABSTRACT

An audio-visual alarm includes a flashtube and a voltage signal generator for producing and storing voltages sufficient to operate the flashtube. In series with the flashtube and the voltage generator is the coil of an audio alarm, whereby operation of the flashtube also operates the audio alarm. The audio alarm is selected so that its coil will not interfer with the operation of the flashtube.

5 Claims, 2 Drawing Figures

AUDIO-VISUAL SIGNAL CIRCUITS

BACKGROUND OF THE INVENTION

This invention relates to alarm circuits and, more particularly, to audio-visual alarms.

Persons with normal sight and hearing are more likely to notice a signal that is both auditory and visual. For example, when the background light or sound is very intense, a visual or auditory signal, respectively, is less readily detected. Since it is not always possible to know in advance whether the background light or sound will be sufficiently low to permit reliable detection of a signal, providing both types of signals together will give people the best opportunity to receive the warning.

According to standard 72A of the National Fire Protection Association (NFPA), the signal for evacuation of a building is three short audible bursts. However, people who are deaf will not be alerted to this or other alarms. If a visual alarm is substituted for the audio alarm, blind people will not be warned. Therefore, it would be advantageous for this segment of the population if an audio-visual alarm were provided. Further, the audio and visual signals according to Standard 72A should be synchronized so as to reduce confusion among the people who can both see and hear.

Some audio-visual signaling devices, such as that in U.S. Pat. No. 2,696,598 to Lozowski, supply the power for an audio signal, such as a horn, and a visual alarm, e.g. a lamp, over separate circuits, thus requiring complicated mechanisms for operating one of the signals in response to the activation of the other.

When a bell system is used as an audio alarm, a coil for activating the clapper is placed in series with the clapper contacts and a power source. When the power is turned on the contacts open due to the field set up by the coil. This contact opening interrupts the current, thereby causing the field to collapse and the contacts to close again. This repeats at the natural frequency of the unit. According to U.S. Pat. No. 3,810,149 to Miller et al., the collapsing field produced by the bell coil can be used to generate a voltage that operates a neon signal light connected across the coil, thus providing both audio and visual signals. A neon light, however, does not provide the intensity of signal that is desirable to overcome background lighting. U.S. Pat. No. 4,101,880 which issued to Rein Haus, the present inventor, and is assigned to the assignee of the present invention, also discloses a bell system operated by placing the bell coil, clapper contacts and a voltage source in series, as in the Miller et al. patent. However, the field from the coil is used to charge a storage capacitor through a diode. When the voltage across the capacitor has reached a critical voltage, a Xenon flashtube in parallel with the capacitor operates and the bell is momentarily silenced. Thus a strong light flash is produced along with a pulsating bell signal that is synchronized to it. Nevertheless, it would be advantageous if a single stroke audible alarm could be operated simultaneously with a flashtube by means of a simple, inexpensive and energy efficient circuit.

SUMMARY OF THE INVENTION

The present invention is directed to providing a synchronized audio-visual alarm that is simple and inexpensive, which object is achieved by connecting the coil of an audio alarm in the current discharge path of a flashtube.

In an illustrative embodiment of the invention, a voltage source charges a capacitive storage element that in turn supplies a voltage across a flashtube and to its trigger terminal. The voltage rises in amplitude until the flashtube operates, causing the voltage to be discharged as current flows from the capacitor through the flashtube producing a bright light. Connected in series with the capacitor and the flashtube is the armature winding of an audio alarm, e.g. the solenoid of a bell or chime. As a result the electromagnet formed by the winding is strongly energized for the duration of the discharge current pulse. By selecting an audio alarm with the appropriate winding impedance and inductance, the flashtube will function normally and the winding will actuate a plunger so as to strike a sound producing surface, e.g. a bell shell or chime bar. Thus an audio signal will sound in unison with each flash of the visual alarm.

BRIEF DESCRIPTION OF THE DRAWINGS

The foregoing and other features of the present invention will be more readily apparent from the following detailed description and drawings of illustrative embodiments of the invention in which.

DESCRIPTION OF EXEMPLARY EMBODIMENTS

Figure 1:
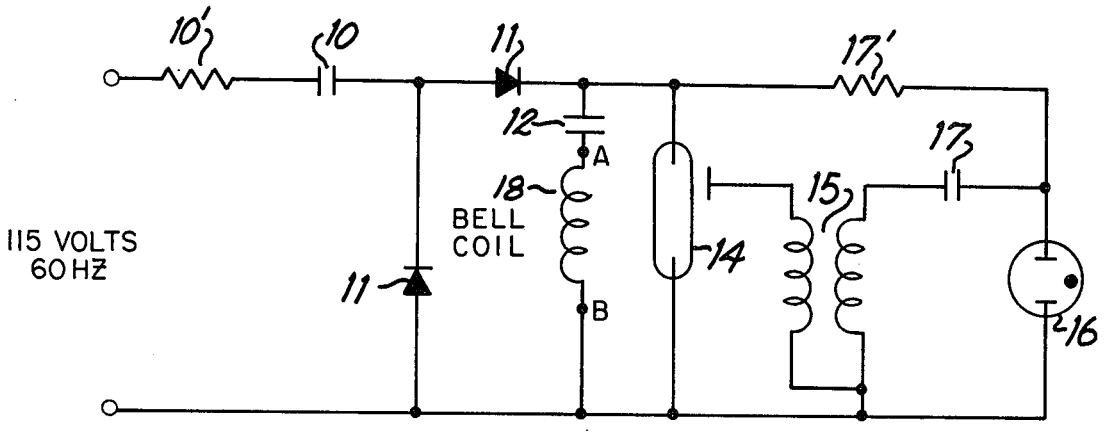
FIG. 1 is a schematic diagram of a circuit for operating the audio-visual alarm of the present invention from an a.c. power source.

In FIG. 1 there is shown a circuit for simultaneously operating a Xenon flashtube or strobe 14, e.g. Siemens model No. AG-1015, and a bell with an armature coil 18. The input to the circuit is a standard 115 volt, 60 Hz power line. This input is delivered to a voltage doubler formed by coupling capacitor 10, diodes 11 and storage capacitor 12. Because of the action of the voltage doubler, the voltage on capacitor 12 builds up until it is equal to about twice the input voltage, approximately 200 volts.

The storage capacitor 12 is connected in series with the armature winding or bell coil 18 of the bell, which may be a Wheelock Serial No. 41 or Ser. No. 60 single stroke bell. This combination is positioned across the flashtube or strobe so that when the flashtube breaks down and begins to conduct, the capacitor, bell coil and flashtube are in series in the current discharge path.

In order to operate the flashtube, the voltage of capacitor 12 is applied across the flashtube via coil 18 and through a resistor 17' to a neon discharge tube or spark gap 16, which may be a Siemens model KAS-02. When the voltage across the neon tube reaches the breakdown level of the neon tube, it begins to conduct, thus generating a voltage spike that is applied to the trigger terminal of the flashtube through a capacitor 17 and a pulse transformer 15, which may be a Shigoto model TR-4KN. The spike applied to the trigger terminal ionizes the flashtube and allows storage capacitor 12 to dump its energy through the flashtube. The movement of this energy through the flashtube causes it to produce a bright flash of light and also energizes the bell coil in series with the flashtube, thus producing an audible sound concurrent with the visible flash of tube 14.

The circuit of FIG. 1 will operate periodically at a rate determined principally by the doubler time constant set by input resistor 10' and capacitors 10 and 12, which control the rise in the voltage applied across the flashtube and to the trigger circuit, since the trigger circuit time constant from capacitor 17 and resistor 17' is much smaller than the doubler time constant. The firing level of the neon tube also affects the repetition rate. If a counter circuit (not shown) is included, it can be set to count three pulses and then to reset the circuit after a delay, thereby creating the signal required under NFPA standard 72A.

A breakdown of the flashtube causes a current surge that is resisted by the bell coil. Therefore, it is important that the inductance and impedance of the bell coil be such that the current that flows is sufficient to activate the bell without affecting the operation of the flashtube. It has been found in practice that satisfactory operation is achieved when capacitor 12 is 100 microfarads, the flashtube is a Xenon AG-1015 and the bell is either a Wheelock Serial 41 or 60 single stroke bell.

Figure 2:
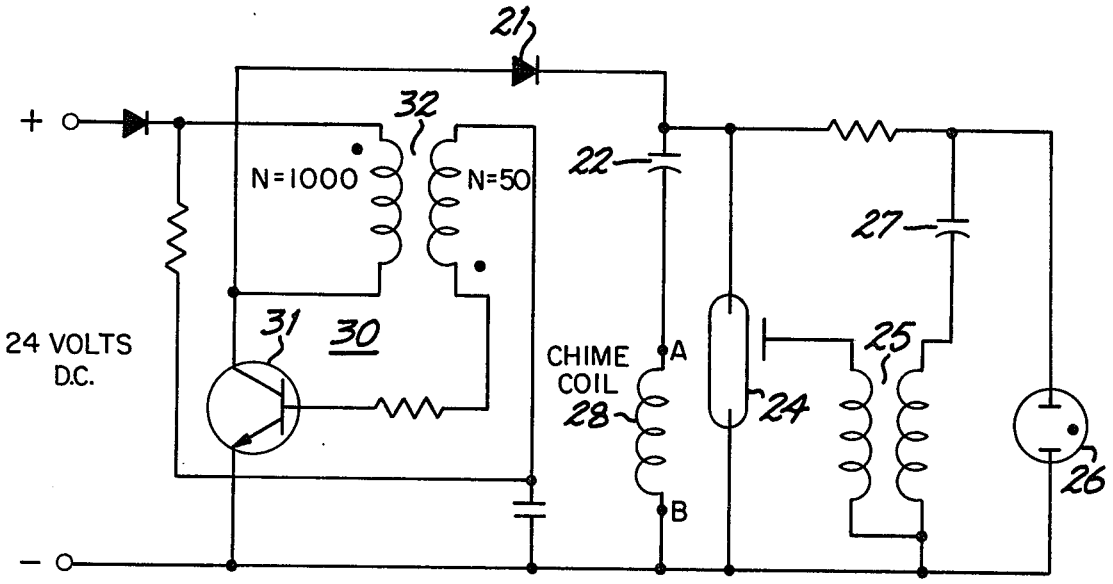
FIG. 2 is a schematic diagram of a circuit analogous to that of FIG. 1, but operated from a d.c. power source.

FIG. 2 is like a flashtube or strobe circuit disclosed in FIG. 7 of a copending application of the present inventor, Ser. No. 905,777 which was filed May 15, 1978 now abandoned and is assigned to the present assignee. The principal differences are that storage capacitor 22 in FIG. 2 is larger than that in the copending application and in FIG. 2 a coil 28 of a single-stroke chime is inserted in series with the storage capacitor. Any of the other more conventional strobe circuits shown in the copending application and elsewhere will also work with the concept of the present invention.

The input to the circuit of FIG. 2 is a 24 volt d.c. source. This input voltage is greatly increased by a d.c. to d.c. converter that includes an oscillator 30 that changes the input d.c. voltage to an a.c. voltage. Oscillator 30 includes transistor 31 and transformer 32, which has its primary in the collector of transistor 31. Acting in the manner of a flyback transformer, an a.c. voltage is created at the junction of the transistor and transformer, which voltage is related to the frequency of operation. This voltage is applied through diode 21, where it is rectified, to storage capacitor 22. Because of the transformer action, the input d.c. voltage is converted to a much higher d.c. voltage (e.g. 300 volts) at the storage capacitor for use in operating the flashtube. The rest of the circuit of FIG. 2 operates like the circuit of FIG. 1. In particular the voltage rise across capacitor 22 eventually causes neon tube 26 to breakdown, whereby a voltage spike is created and is passed to the trigger terminal of the flashtube through capacitor 27 and transformer 25. This spike causes the flashtube to ionize, producing a flash of light and a flow of current through chime coil 28. As a result the chime operates simultaneously with the flashtube.

The circuit arrangement according to the present invention represents a very cost effective way to produce an audio-visual signal. The short, high current discharge pulse typical of flashtube circuits is well suited to energizing a conventional "single-stroke" bell or chime. Because of the brief pulse, a high intensity magnetic field can be developed without overheating or "double-tap" problems. This results in significantly improved operation of the audible signal devices, i.e. louder sound output and less energy consumption. It also produces a simultaneous audio-visual signal which may be coded and is especially effective for people with either hearing or sight impairments.

In either FIG. 1 or FIG. 2, the coil between points A and B may be a part of a bell or chime, or some other electromagnetic coil which generates an audible sound when energized by a brief current spike. Points A and B can be placed anywhere in the discharge loop formed by the storage capacitor and the flashtube. The coil does not have to be directly related to an audible signal and may be a relay coil or a solenoid valve coil for example.

While the present invention has been particularly shown and described with reference to preferred embodiments thereof, it will be understood by those skilled in the art that various changes in form and details may be made therein without departing from the spirit and scope of the invention.

I claim:

1. A circuit for producing an audio-visual alarm comprising:

a flashtube;

voltage signal generator means for generating and storing a first voltage across said flashtube and a second voltage on the trigger terminal of said flashtube, said first and second voltages increasing in amplitude to a point at which said flashtube operates, discharging the stored voltage and delivering current from said generator means through said flashtube; and audio signal generator means including a coil located in series with said flashtube and said voltage signal generator means, for producing an audible sound in response to the flow of current from said voltage signal generator means, upon discharge of said stored voltage, the inductance of said coil being such that the current flow through it and the operation of the flashtube are not adversely affected.

2. A circuit as claimed in claim 1 wherein the voltage signal generator means comprises an a.c. voltage source, a voltage doubler for increasing the amplitude of the voltage and converting it into a high d.c. voltage, and a storage capacitor for storing the high d.c. voltage.

3. A circuit as claimed in claim 1 wherein the voltage signal generator means comprises a low voltage d.c. source, a d.c. to d.c. converter for increasing the amplitude of the voltage and converting it into a high d.c. voltage; and a storage capacitor for storing the high d.c. voltage.

4. A circuit as claimed in claims 1, 2, or 3 wherein the audio signal generator comprises a single stroke bell having an armature winding, said coil comprising said armature winding.

5. A circuit as claimed in claims 1, 2 or 3 wherein the audio signal generator comprises a single stroke chime having an armature winding, said coil comprising said armature winding.

* * * * *